US005266886A

United States Patent [19]

Landgraf

[11] Patent Number: 5,266,886

[45] Date of Patent: Nov. 30, 1993

[54] CMOS POWER SUPPLY VOLTAGE LIMITER

[75] Inventor: Mark Landgraf, Folsom, Calif.

[73] Assignee: Intel Corporation, Santa Clara, Calif.

[21] Appl. No.: 965,805

[22] Filed: Oct. 23, 1992

[51] Int. Cl.[5] ..... G05F 3/16

[52] U.S. Cl. ..... 323/314; 323/313; 307/296.8

[58] Field of Search ..... 323/311-315, 323/281; 307/296.6, 296.7, 296.8, 296.1, 29.2

[56] References Cited

U.S. PATENT DOCUMENTS

| | | | |
|---|---|---|---|
| 4,675,557 | 6/1987 | Huntington | 307/475 |
| 4,694,199 | 9/1987 | Goetz | 307/297 |
| 4,814,686 | 3/1989 | Watanabe | 323/229 |
| 4,868,483 | 9/1989 | Tsujimoto | 323/313 |
| 5,045,772 | 9/1991 | Nishiwaki et al. | 323/313 |
| 5,179,297 | 1/1993 | Hsueh et al. | 307/296.6 |

*Primary Examiner*—Steven L. Stephan
*Assistant Examiner*—Adolf Berhane
*Attorney, Agent, or Firm*—Blakely, Sokoloff, Taylor & Zafman

[57] ABSTRACT

A circuit for limiting a voltage appearing at an output terminal to a preselected range of voltages including a plurality of field effect transistors connected in series between first and second levels of potential to form a voltage divider network of the potential difference between the first and second levels of potential; an output field effect transistor having source, drain, and gate terminals, the source and drain terminals being connected between the first level of potential and the output terminal; and apparatus operating in response to a voltage provided by the voltage divider network for biasing the gate terminal of the output field effect transistor to transfer the first potential to the output terminal so long as the first potential remains below a predetermined value and for transferring the first potential less the switching voltage of the output field effect transistor to the output terminal if the first potential is greater than the predetermined value.

7 Claims, 2 Drawing Sheets

CMOS POWER SUPPLY VOLTAGE LIMITER

BACKGROUND OF THE INVENTION

1. Field Of The Invention

This invention relates to control circuitry, and more particularly, to apparatus for limiting an output voltage range provided by power supplies which furnish an undesirably wide range of voltages.

2. History Of The Prior Art

Portable computers are a rapidly growing segment of the personal computer market. The portable computer market has taken longer to develop because of the inability of manufacturers to produce such computers which are capable of operating for long enough periods on a single battery charge to make them useful. Initially, portable computers were constructed using the same components as desktop computers and adding a battery to power the components. These computers were quite heavy and would operate for little over an hour on batteries. Then, attempts were made and continue to make batteries more powerful and lighter so that they will operate computers for longer periods. In general, newer types of batteries are lighter and more powerful than older types. However, at the same time, other attempts have proceeded to reduce the power requirements of portable computers by utilizing components which are lighter or which require less power so that computers can operate for longer periods using batteries which are available.

The attempts to reduce the power requirements of portable computers have produced circuits which function at different voltage levels. Some times these levels vary within a computer. Certain circuitry may operate at a first voltage of, for example, three and one-half volts; while other circuitry operates at a second voltage level such as five volts. In other instances, all of the circuits of one computer use a supply voltage of three ad one-half volts, while those of another computer use a power supply of five volts.

This use by computer manufacturers of different supply voltages creates a number of problems for those who manufacture components which are used with portable computers. A major problem is that it is necessary to manufacture different components for each section of the market which has different source voltage requirements. Some of these market sections may be too small to warrant the cost involved in producing a particular component. Other market sections may require that two devices be used in the same computer.

Consequently, it would be desirable to furnish some arrangement which would allow peripheral components to function with different sources of voltage so that different components need not be designed for the different segments of the market which use different source voltages.

SUMMARY OF THE INVENTION

It is, therefore, an object of the present invention to provide a circuit for limiting the voltage furnished by voltage sources so that the voltage outputs of the circuit lie in a range adapted to drive circuitry within a portable computer for sources providing a large range of voltages.

It is another more specific object of the present invention to provide a voltage limiting circuit utilizing a very few circuit elements capable of providing a narrow range of voltages for a plurality of differing voltage sources.

These and other objects of the present invention are realized in a circuit for limiting a voltage appearing at an output terminal to a preselected range of voltages including a plurality of field effect transistors connected in series between first and second levels of potential to form a voltage divider network of the potential difference between the first and second levels of potential; an output field effect transistor having source, drain, and gate terminals, the source and drain terminals being connected between the first level of potential and the output terminal; and apparatus operating in response to a voltage provided by the voltage divider network for biasing the gate terminal of the output field effect transistor to transfer the first potential to the output terminal so long as the first potential remains below a predetermined value and for transferring the first potential less the switching voltage of the output field effect transistor to the output terminal if the first potential is greater than the predetermined value.

These and other objects and features of the invention will be better understood by reference to the detailed description which follows taken together with the drawings in which like elements are referred to by like designations throughout the several views.

DETAILED DESCRIPTION

Figure 1:
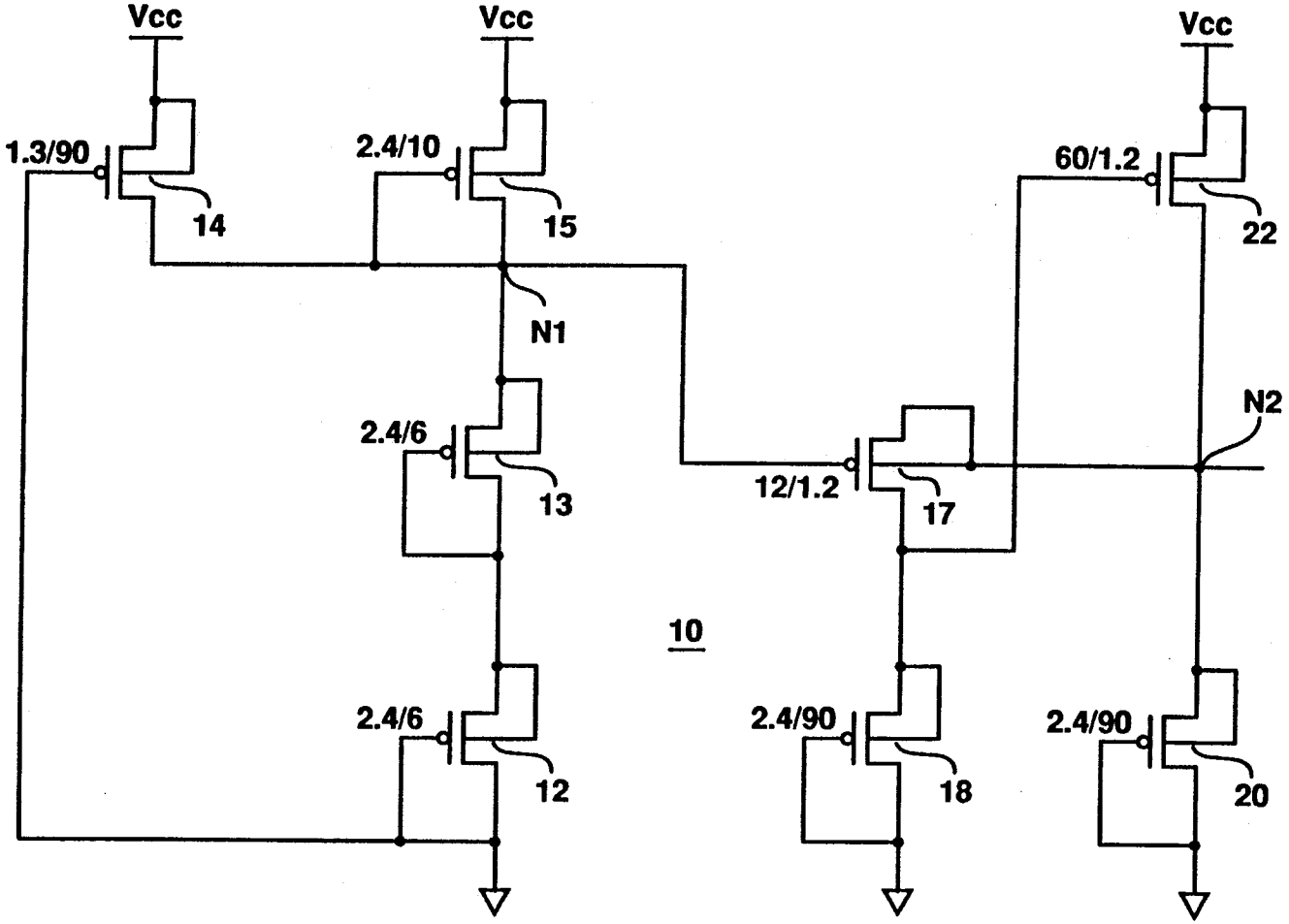
FIG. 1 is a circuit diagram illustrating a voltage limiting circuit constructed in accordance with the present invention.

Referring now to FIG. 1, there is illustrated a circuit diagram of a circuit 10 designed in accordance with the present invention. The circuit 10 includes a first P type field effect transistor device 12 having its source and drain terminals connected in series with the source and drain terminals of a second P type field effect transistor device 13 between a node N1 and ground potential. Between the node N1 and a source of potential Vcc are connected the source and drain terminals of two additional P type field effect transistor devices 14 and 15. The gate terminal of the device 12 is connected to ground, and the gate terminal of the device 13 is connected between the devices 12 and 13. The gate terminal of the device 15 is connected to the node N1, and the gate terminal of the device 14 is connected to ground. Since the gates of each of the devices 12 and 14 are connected to ground, each gate is more negative than the source of the device; and these two devices are biased on. Since the devices 12 and 14 are on, the gates of each of the devices 13 and 15 are more negative than the sources of those devices; and the devices 13 and 15 are also biased on. Since the three devices 12, 13, and 15 are all arranged in a diode connection in which the gate terminal of each device is joined directly to its drain terminal, the two devices 12 and 13 form a voltage divider with the device 15. In one embodiment of the invention, the values of the devices 12, 13, and 15 are selected in a manner well known to those skilled in the art to be such that approximately two thirds of the voltage difference between Vcc and ground is provided between the node N1 and ground.

The voltage at the node N1 is provided at the gate terminal of another P type field effect transistor device 17. The device 17 has its source terminal connected to another node N2 and its drain terminal connected to the source terminal of another P type field effect transistor device 18. The device 18 has both its gate and drain terminals connected to ground potential. The node N2 is connected between an additional pair of P type field effect transistor devices 20 and 22. The devices 20 and 22 have their source and drain terminals connected in series between the voltage source Vcc and ground potential. The gate terminal of the device 20 is connected to ground, and the gate terminal of the device 22 is connected between the devices 17 and 18.

The arrangement illustrated in FIG. 1 is adapted to limit the voltage at the output terminal which is node N2. The circuit 10 is adapted to function with source voltages which vary from approximately 3 volts to as much as 6 volts yet provide an output voltage at the node N2 which may be used to sense the condition of a flash EEPROM memory cell. Typically such a voltage is applied to the gate of a flash EEPROM device and is at such a level that if the device is programmed it will not conduct while if it is programmed it will conduct.

A flash EEPROM memory cell is a floating gate MOS field effect transistor having a drain region, a source region, a floating gate, and a control gate. Conductors are connected to each of the drain, source, and control gate for applying signals to the transistor. An N type flash memory transistor is programmed (in one embodiment) by negatively charging the floating gate by coupling the control gate to a potential of approximately +12 volts, the drain region to approximately +7 volts, and the source region to ground. With these conditions, charge is stored on the floating gate. A cell is read by applying a positive potential (less than that which would cause charge to transfer onto the floating gate) to the control gate, applying ground to the source region, and applying a potential of 1 volt to the drain region. Current through the device is sensed to determine if the floating gate is or is not negatively charged. If there is charge on the floating gate, then no drain current flows when a cell is read. In contrast, if the transistor has not been programmed and no charge exists on the floating gate, then drain current flows when the cell is read.

In an array in which all of the flash memory transistors are functioning correctly and within tolerances, the gate-source voltage applied to interrogate the cells is greater than the switching voltage Vt of each of the erased cells and less than the switching voltage Vt of each of the programmed cells. The present invention is designed to keep the read voltage within that range for different source voltage levels. Thus, when the gate/source voltage is applied to interrogate an erased cell, the cell will provide a one value. Alternatively, when the gate/source voltage Vcc is applied to interrogate a programmed cell, the cell will provide a zero value.

Presuming that the voltage furnished by the source Vcc is three volts in the circuit of FIG. 1, the devices 12–15 are all biased on. The voltage divider provided by the devices 12, 13, 14, and 15 divides the voltage so the voltage at the node N1 is approximately two volts. This two volts is applied to the gate terminal of the device 17. The device 18 is on and pulls the drain of the device 17 close to ground potential. This turns the device 22 on. At this point the device 22 operates in the resistive region so that the node N2 and the source terminal of the device 17 are at approximately Vcc or three volts. The device 20 is a weak device which transfers little current but allows the node N2 to rise to this value. This maintains the device 17 off for the values of the embodiment illustrated. Thus, the output voltage at the node N2 remains at the value of Vcc.

As will be seen, the difference between the voltage levels applied to the source and the gate terminals of the device 17 is approximately one-third of the value of Vcc and is set by the constants of the voltage divider including the devices 12, 13, 14, and 15. As the value of Vcc is raised, the absolute difference between the voltage levels applied to the source and the gate of the device 17 increases to a point at which that difference becomes greater than the value of the switching voltage Vt of the device 17. When the value of Vcc reaches this point, the device 17 turns on. When the device 17 turns on, the voltage at the gate terminal of the device 22 is raised to approximately the same voltage as that at node N2. The voltage at the drain terminal of the device 17 may rise because the device 18 is a weak device and acts like a very large resistor. With the voltage at the gate and drain terminals of the device 22 equal, the device 22 moves to the saturation portion of its operating region at which there is a Vt drop across the device 22. Thus, the voltage at the node N2 drops by the amount of the voltage drop Vt of the device 22. This reduces the voltage at the output node N2 by the amount of the voltage drop Vt of the device 22.

Figure 2:
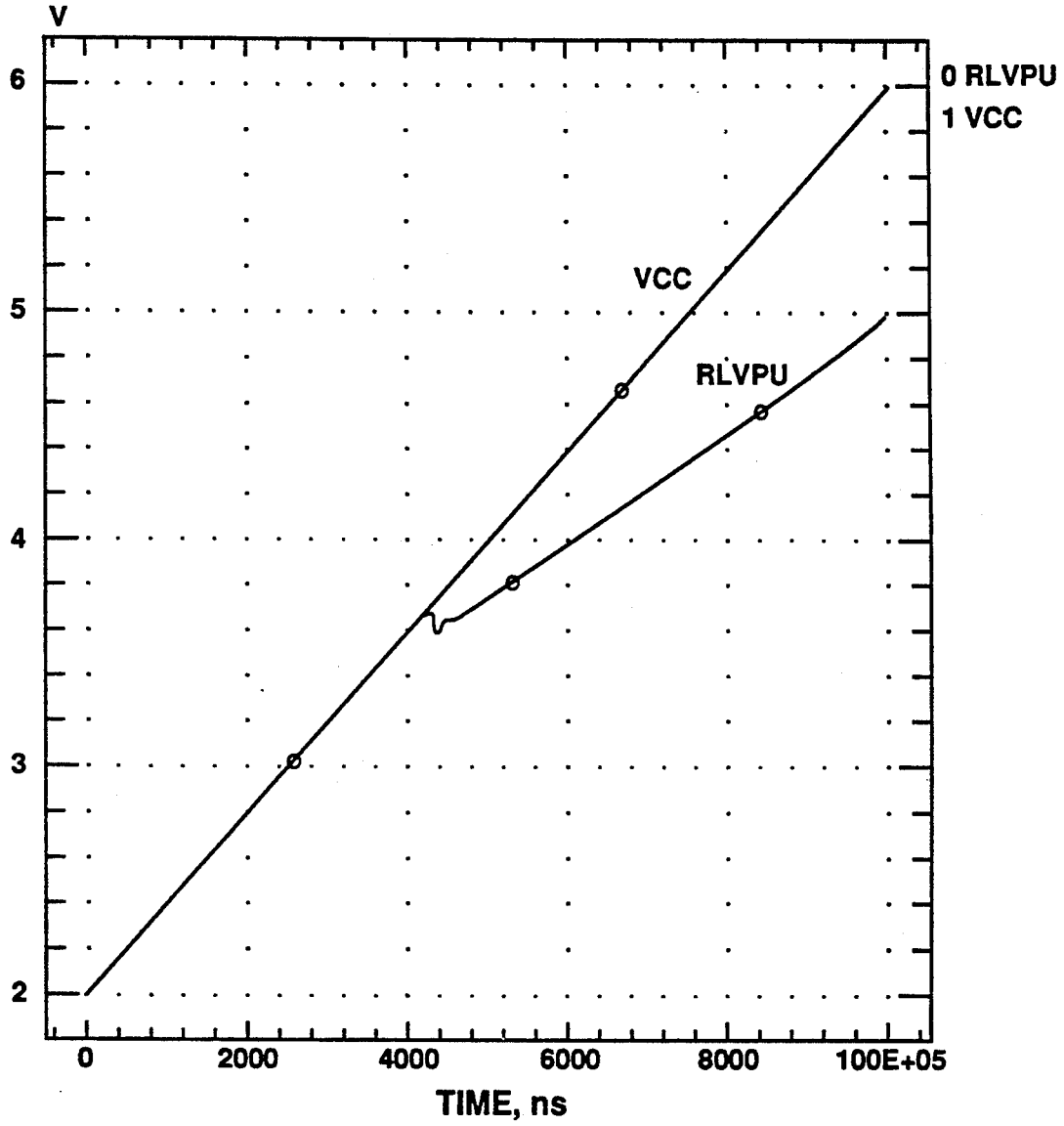
FIG. 2 is a graph illustrating output voltages produced by the circuit of FIG. 1 in response to various source voltages.

Reducing the voltage at the node N2 reduces the voltage which is to be used as a source voltage for application to the gates of flash EEPROM memory transistors when the condition of those transistors is read. By limiting this voltage, the voltage used as a source is limited to a range in which its application will successfully allow the reading of the flash memory transistor devices whether in the programmed or erased condition. This allows different values of Vcc to be used with the particular flash EEPROM circuitry. In the embodiment disclosed, these voltages may range from three to six volts. Any value of Vcc within this range will allow proper operation of the flash EEPROM memory devices. FIG. 2 illustrates in graphical form the voltage output provided by the circuit 10 at node N2 utilizing the devices illustrated in the circuit of FIG. 2. As may be seen, as the voltage level of the source Vcc varies from three volts to approximately three and one-half volts, the voltage applied at the output terminal of node N2 follows the value of Vcc. At approximately 3.6 volts, the value of Vcc is at a point that the device 17 begins to conduct; and the output voltage at the node N2 is reduced by the value of the switching voltage Vt of the device 22. As the value of Vcc is raised to six volts, the output voltage at the node N2 reaches a value of approximately 5.0 volts. This reduced value of the source for the output allows the flash EEPROM devices driven by that device to be read correctly whether the value of the source voltage Vcc is three or six volts or some value between those values.

Although the present invention has been described in terms of a preferred embodiment, it will be appreciated that various modifications and alterations might be made by those skilled in the art without departing from the spirit and scope of the invention. For example, although the circuit has been described in the context of limiting the range of voltages applied to the gates of flash EEPROM memory devices to read the condition of those devices, it may as well find use in other arrangement in which a limited range of voltages is desired. The invention should therefore be measured in terms of the claims which follow.

What is claimed is:

1. A circuit for limiting a voltage appearing at an output terminal to a preselected range of voltages comprising a plurality of field effect transistors having source, drain, and gate terminals, the source and drain terminals of the plurality of transistors being connected in series between first and second levels of potential to form a voltage divider network of a potential difference between the first and second levels of potential; an output field effect transistor having source, drain, and gate terminals, the source and drain terminals being connected between the first level of potential and the output terminal; and means connected between the voltage divider network and the output field effect transistor, operating in response to a voltage provided by the voltage divider network for biasing the gate terminal of the output field effect transistor to transfer the first level of potential to the output terminal so long as the first level of potential remains below a predetermined value and for transferring the first level of potential less the switching voltage of the output field effect transistor to the output terminal if the first potential is greater than the predetermined value.

2. A circuit for limiting a voltage appearing at an output terminal to a preselected range of voltages as claimed in claim 1 in which the means operating in response to a voltage provided by the voltage divider network for biasing the gate terminal of the output field effect transistor comprises means for applying one voltage to the gate terminal of the output transistor while the first potential remains below the predetermined value, and means for applying another voltage to the gate terminal of the output transistor when the first potential is greater than the predetermined value.

3. A circuit for limiting a voltage appearing at an output terminal to a preselected range of voltages as claimed in claim 2 in which the means for applying one voltage to the gate terminal of the output transistor while the first potential remains below the predetermined value comprises another field effect transistor device biased to apply the second potential to the gate terminal of the output transistor, and the means for applying another voltage to the gate terminal of the output transistor when the first potential is greater than the predetermined value comprises a field effect transistor for applying a voltage approximately equal to the output voltage to the gate of the output transistor when the first potential is greater than the predetermined value.

4. A circuit for limiting a voltage appearing at an output terminal to a preselected range of voltages as claimed in claim 3 in which the last-mentioned field effect transistor has a gate terminal coupled to receive a potential from the voltage divider network.

5. A circuit for limiting a voltage level appearing at an output terminal to a preselected range of voltage levels comprising:

a source of voltage;

an output terminal;

a voltage divider circuit;

a first P type field effect transistor having its source and drain terminals connected between the source of voltage and the output terminal, and means, connected between the voltage divider circuit and the first P type field effect transistor, responsive to the voltage level at the source of voltage for biasing the first P type field effect transistor to operate in its resistive range and maintain the voltage level at the output terminal approximately equal to the voltage level provided by the source of voltage so long as the voltage level provided by the source of voltage remains below a predetermined value, and to operate in its saturation range and maintain the voltage level at the output terminal approximately equal to the voltage level provided by the source of voltage less the value of the switching voltage of the first P type field effect transistor when the source of voltage furnishes a voltage value greater than the predetermined value.

6. A circuit for limiting a voltage level appearing at an output terminal to a preselected range of voltage levels as claimed in claim 5 in which the means responsive to the voltage level at the source of voltage for biasing the first P type field effect transistor comprises;

means for furnishing a level voltage at a gate terminal of the first P type field effect transistor to hold the first P type field effect transistor in its resistive range while the voltage level furnished by the source of voltage is less than the predetermined level, a second P type field effect transistor having source and drain terminals connected between the gate terminal of the first P type field effect transistor and a source of voltage sufficient to switch the first P type field effect transistor to its saturation range, and means for applying a voltage between source and gate terminals of the second P type field effect transistor to keep the second P type field effect transistor off until the voltage level at the source of voltage reaches the predetermined level.

7. A circuit for limiting a voltage level appearing at an output terminal to a preselected range of voltage levels as claimed in claim 6 in which the means for applying a voltage between source and gate terminals of the second P type field effect transistor to keep the second P type field effect transistor off until the voltage level at the source of voltage reaches the predetermined level comprises the voltage divider circuit, connected between the source of voltage and a second level of voltage, and means joining the gate terminal of the second P type field effect transistor to the voltage divider.

* * * * *